US009826819B2

(12) United States Patent
Huang

(10) Patent No.: US 9,826,819 B2
(45) Date of Patent: Nov. 28, 2017

(54) TOOL BAG HAVING MEANS TO PREVENT TOOLS FROM FALLING OUT OF THE SAME

(71) Applicant: CASTIP INDUSTRIAL CO., LTD, New Taipei (TW)

(72) Inventor: Heng-Fong Huang, New Taipei (TW)

(73) Assignee: Castip Industrial Co., Ltd., New Taipei (TW)

( * ) Notice: Subject to any disclaimer, the term of this patent is extended or adjusted under 35 U.S.C. 154(b) by 161 days.

(21) Appl. No.: 15/068,163

(22) Filed: Mar. 11, 2016

(65) Prior Publication Data

US 2017/0258211 A1 Sep. 14, 2017

(51) Int. Cl.

| | |
|---|---|
| ***A45F 5/02*** | (2006.01) |
| ***B25H 3/00*** | (2006.01) |
| ***B65D 33/01*** | (2006.01) |
| ***B65D 33/25*** | (2006.01) |

(52) U.S. Cl.
CPC ..... *A45F 5/021* (2013.01); *B25H 3/00* (2013.01); *B65D 33/01* (2013.01); *B65D 33/25* (2013.01)

(58) Field of Classification Search
CPC ... A45F 5/021; A45F 2200/0575; B25H 3/00; B25H 3/003; B65D 33/01; B65D 33/007; B65D 33/16; B65D 33/25
See application file for complete search history.

(56) References Cited

U.S. PATENT DOCUMENTS 4,923,105 A * 5/1990 Snyder ..... A45F 3/14 224/232
5,067,821 A * 11/1991 Young ..... A61F 5/44 383/36
5,072,868 A * 12/1991 Dickie ..... B44D 3/123 220/736
5,201,448 A * 4/1993 Schue ..... B25H 3/00 2/300
5,354,132 A * 10/1994 Young ..... A61F 5/44 383/10
6,527,444 B1 * 3/2003 Buchman ..... B65D 33/2591 383/204
6,554,810 B1 * 4/2003 Wilk ..... A61J 19/00 248/99
8,220,683 B2 * 7/2012 Williams ..... A45F 3/14 224/662
2003/0071095 A1 * 4/2003 Dedrick ..... A45F 5/00 224/183
2003/0197042 A1 * 10/2003 Warren ..... A45C 1/04 224/183
2006/0266782 A1 * 11/2006 Godshaw ..... A45F 5/02 224/674

* cited by examiner

*Primary Examiner* — Corey Skurdal
(74) *Attorney, Agent, or Firm* — Wang Law Firm, Inc.

(57) ABSTRACT

A tool bag includes: a main bag body having an upward opening, defining a receiving space, wherein a periphery defining the upward opening is stitched in such a manner to form a space for receiving a flexible edge plate such that the upward opening defines a gap that gradually decreases from a middle portion toward two opposite ends of the middle portion. Two flexible sheets are attached to inner side surfaces of the bag body to define an upper opening proximate to the upward opening and a lower bottom that is distal from the upward opening, that is located within the receiving space and that define a cross section smaller than the upper opening so as to prevent falling of tool from the receiving space.

8 Claims, 10 Drawing Sheets

TOOL BAG HAVING MEANS TO PREVENT TOOLS FROM FALLING OUT OF THE SAME

BACKGROUND OF THE INVENTION

1. Field of the Invention

The present invention relates generally to a tool bag, and more particularly to a tool bag having means to prevent tools from falling out of the same.

2. The Prior Arts

A tool bag is often buckled around the waist of a worker (like a construction worker working on a construction site), has a receiving space in order to carry different types of tools therein which are required to by the worker for installing, repairing and testing operations.

However, during the working period, the tool bag may be tilted due to many circumstances such that the tools kept in the tool bag can fall from an opening of the tool bag, thereby leading to damage of tools and hence resulting in undesired purchase of tools or injuring the legs of the worker. To be more specific, this drawback may hinder progress of the working performance and if the worker is working high above the ground, the falling tool may cause fatal injury to passing-by people.

The reasons reside in that the conventional tool bag only has a receiving space to carry tools therein, but does not have means to prevent falling of tools from the receiving space. Therefore, it is urgently required to develop a tool bag having means to prevent tools from falling out of the same

SUMMARY OF THE INVENTION

A primary objective of the present invention is to provide a tool bag having means to prevent tools from falling out of the same so as to eliminate the prior art drawbacks.

A tool bag having means to prevent tools from falling out of the same according to the present invention includes a main bag body and at least two flexible sheets. The main bag body has an upward opening, first and second sides mutually symmetrically situated relative to each other, third and fourth sides mutually symmetrically situated relative to each, and a bottom side connected to lower ends of the first, second, third and fourth sides to define a receiving space accessible from the upward opening, wherein a periphery defining the upward opening is bent and stitched in such a manner to form an enclosed space for receiving a flexible edge plate therein such that the upward opening defines a gap that gradually decreases from a middle portion toward two opposite ends of the middle portion. The flexible sheets are attached to two opposite inner side surfaces of the main bag body in such a manner that the two flexible sheets cooperatively conceal the receiving space at a lower level but exposing the upward opening at an upper level, wherein the flexible sheets define in a normal condition an upper opening proximate to the upward opening of the main bag body and a lower bottom that is distal from the upward opening, that is located within the receiving space and that define a cross section smaller than the upper opening, thereby preventing tools in the receiving space from falling out of the main bag body.

In this embodiment, the tool bag of the present invention further includes a fastener strap mounted on an outer side surface of the main bag body in order to facilitate extension of a belt through for buckling the main bag body around a worker's waist. Preferably, the fastener strap is further provided with a hanging loop such that the main bag body is adapted to be hung to the belt buckled around the worker's waist. Alternately, the main bag body can be hung onto the hook of a wall via the hanging loop if the wall nearby the worker working is provided with the hook.

Preferably, the tool bag of the present invention further includes a spacer element mounted on the bottom side of the main bag body and extending upward to terminate adjacent to the lower bottom defined by the two flexible sheets, thereby separating the receiving space into different layers or several chambers to facilitate placement of tools therein.

Because, the tool bag of the present invention is usually attached to a belt, which in turn, is buckled around a worker's waist, a ventilation hole is formed through the main bag body such that the receiving space is spatially communicated with an exterior of the main bag body so as to reduce the stuffy and rusty feeling due to long term wearing of the belt as well as the tool bag around the worker's waist. Of course, when the receiving space is divided into different layers or several chambers, more ventilation holes can be arranged to enhance air circulation of the tool bag of the present invention.

Preferably, the tool bag of the present invention further includes a zipper stitched to the main bag body such that pulling of the zipper in two opposite directions result in permitting access into and/or denying access into the receiving space. In one embodiment, the tool bag of the presenting invention further includes a flexible strap stitched on an outer side surface of the main bag body in such a manner to define a plurality parallel stitched seams adjacent two of which define an insert hole in which a tool can be kept therein.

The tool bag of the present invention is simple in structure, but provides a long service life and prevents tools from falling out of the same, thereby avoiding the problems of injuring a nearby person due to falling of tools from the main bag body.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

The accompanying drawings are included to provide a further understanding of the invention, and are incorporated in and constitute a part of this specification. The drawings illustrate embodiments of the invention and, together with the description, serve to explain the principles of the invention.

Figure 1:
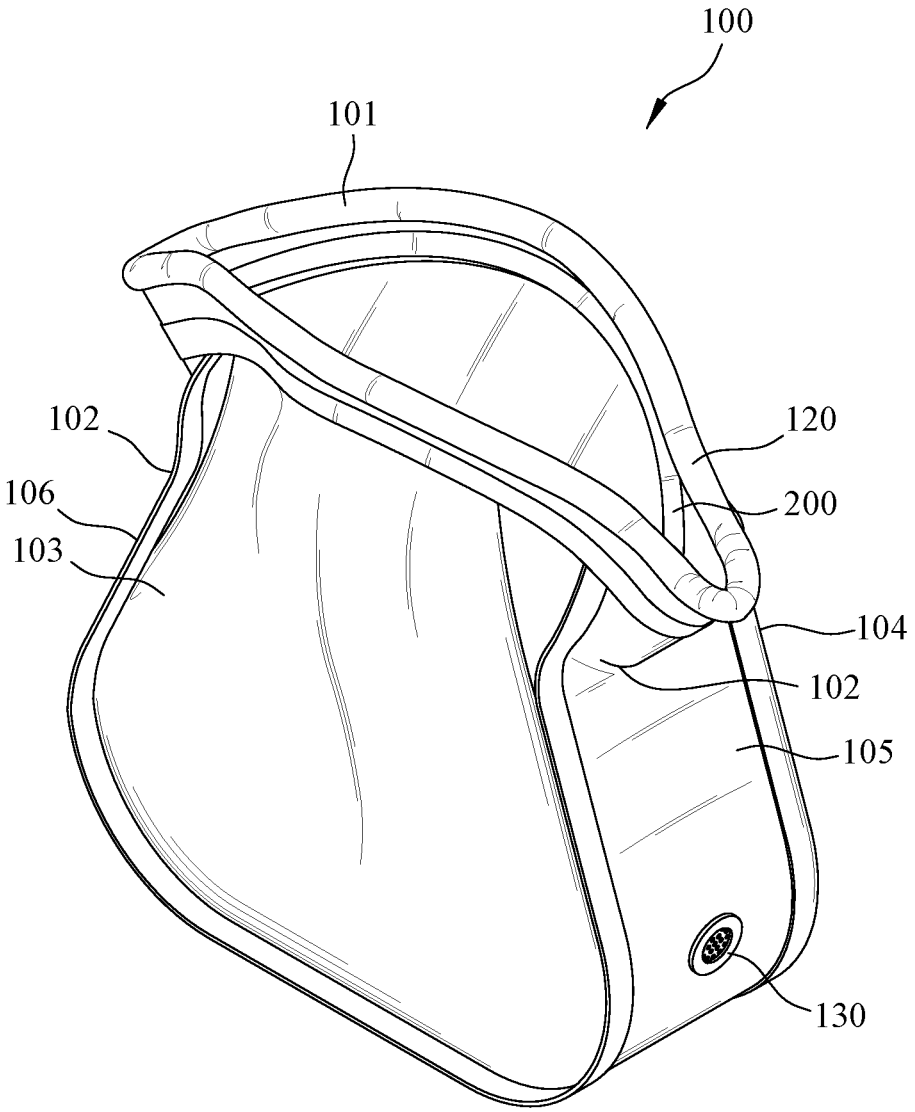
FIG. 1 illustrates a perspective front view of a tool bag according to a first embodiment of the present invention having means to prevent falling of tools therefrom.
Figure 2:
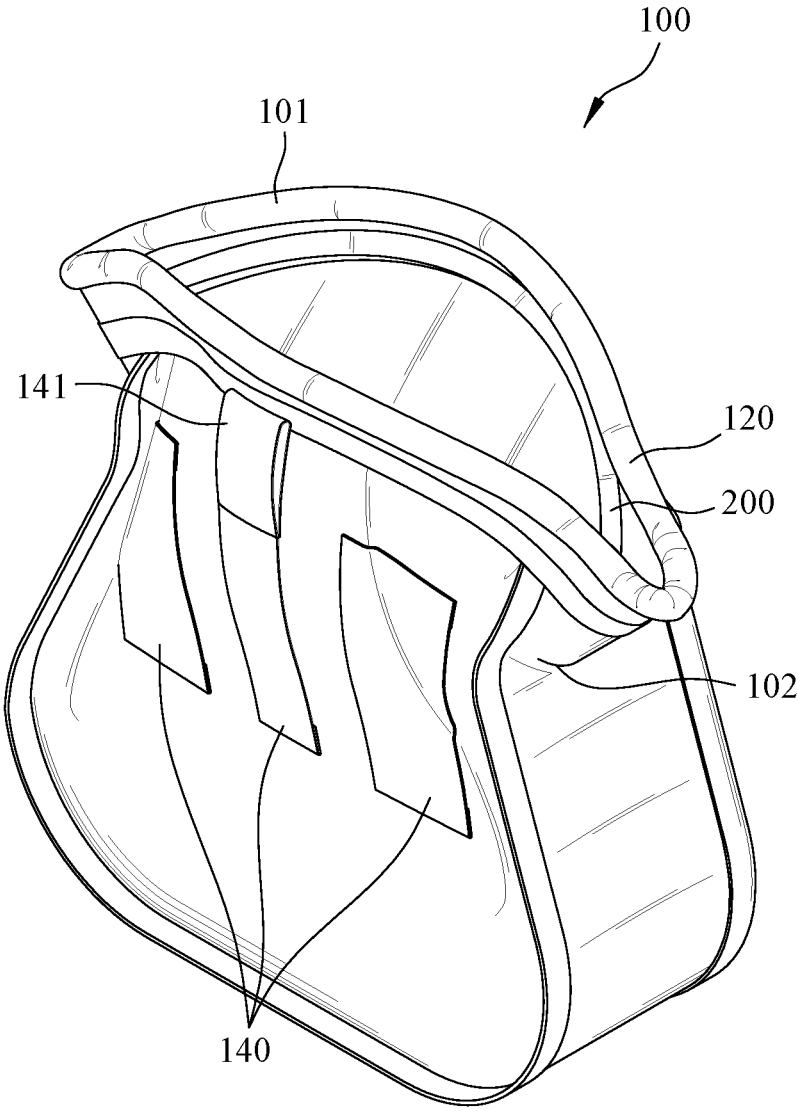
FIG. 2 shows a perspective rear view of the tool bag according to the first embodiment of the present invention.

Referring to FIGS. 1 and 2, wherein FIG. 1 illustrates a perspective front view of a tool bag according to a first embodiment of the present invention having means to prevent falling of tools therefrom; and FIG. 2 shows a perspective rear view of the tool bag according to the first embodiment of the present invention. As shown, a tool bag according to the present invention includes: a main bag body 100 and at least two flexible sheets 200. The main bag body 100 has an upward opening 101, first and second sides 103, 104 mutually symmetrically situated relative to each other, third and fourth sides 105, 106 mutually symmetrically situated relative to each, and a bottom side 107 (see FIG. 4) connected to lower ends of the first, second, third and fourth sides to define a receiving space 110 accessible from the upward opening 101, wherein a periphery defining the upward opening 101 is bent and stitched in such a manner to form an enclosed space for receiving a flexible edge plate 120 (like a flexible plastic plate) therein such that two portions of the flexible edge plate 120 can be stretched away from each other when one wishes to put tools into the receiving space 110 (see FIG. 4). The upward opening 101 defines a gap that gradually decreases from a middle portion toward two opposite ends of the middle portion. In this embodiment, the third and fourth sides 105, 106 of the main bag body 100 cooperative form a restricted portion 102 having a cross section smaller than the upward opening of the main bag body 100, the formation of the restriction portion 102 in the main bag body 100 narrow the dimension of the upward opening 101 so as to facilitates wearing of the tool bag of the present invention around a worker's waist, in addition to prevents tools kept in the receiving space 110 from falling out of the same. How the restricted portion 102 is formed will be given in the following paragraphs.

Figure 3:
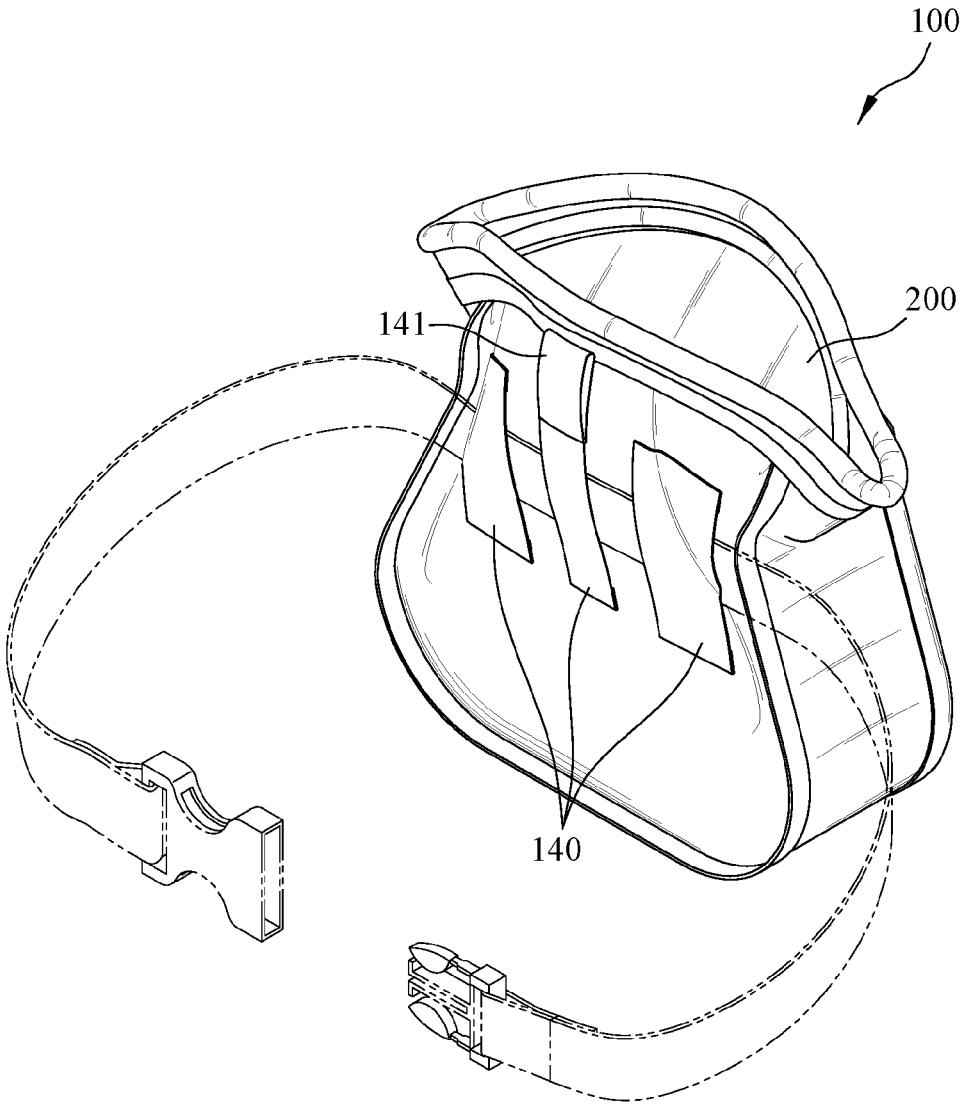
FIG. 3 illustrates the tool bag according to the first embodiment of the present invention in use.

FIG. 3 illustrates the tool bag according to the first embodiment of the present invention in use. The tool bag of the present invention further includes three parallel fastener straps 140 mounted or stitched on an outer side surface of the main bag body 100 in order to facilitate extension of a belt there through for buckling the main bag body 100 around a worker's waist.

Preferably, the fastener strap 140 is further provided with a hanging loop 141 such that the main bag body 100 is adapted to be hung on the belt buckled around the worker's waist. Alternately, the main bag body 100 can be hung onto the hook (not visible) of a wall via the hanging loop 141 if the wall nearby the worker working is provided with the hook.

More preferably, since the tool bag of the present invention is usually attached to a belt, which in turn, is buckled around a worker's waist, a ventilation hole 130 is formed through the main bag body 100 such that the receiving space 110 is spatially communicated with an exterior of the main bag body 100 so as to reduce the stuffy and rusty feeling due to long term wearing of the belt as well as the tool bag of the present invention around the worker's waist.

Figure 4:
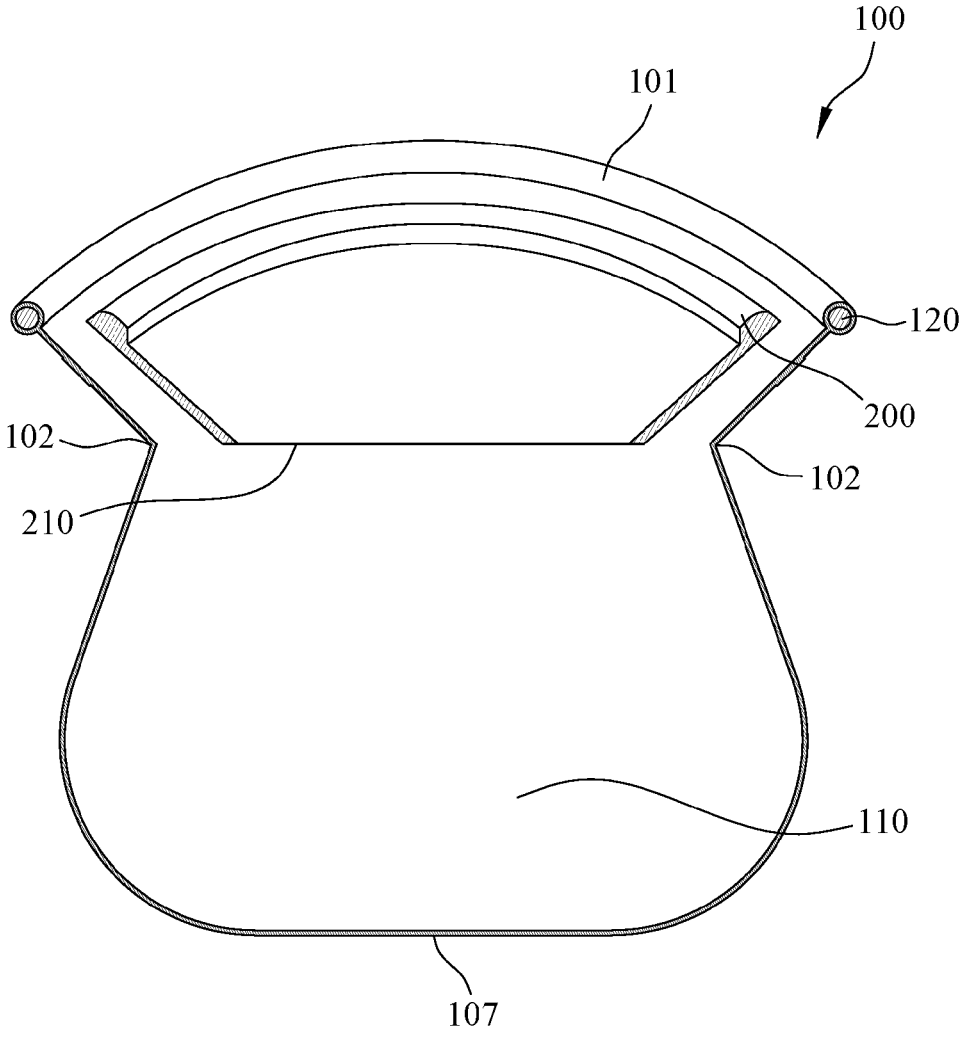
FIG. 4 illustrates a front cross-sectional view of the tool bag according to the first embodiment of the present invention.
Figure 5:
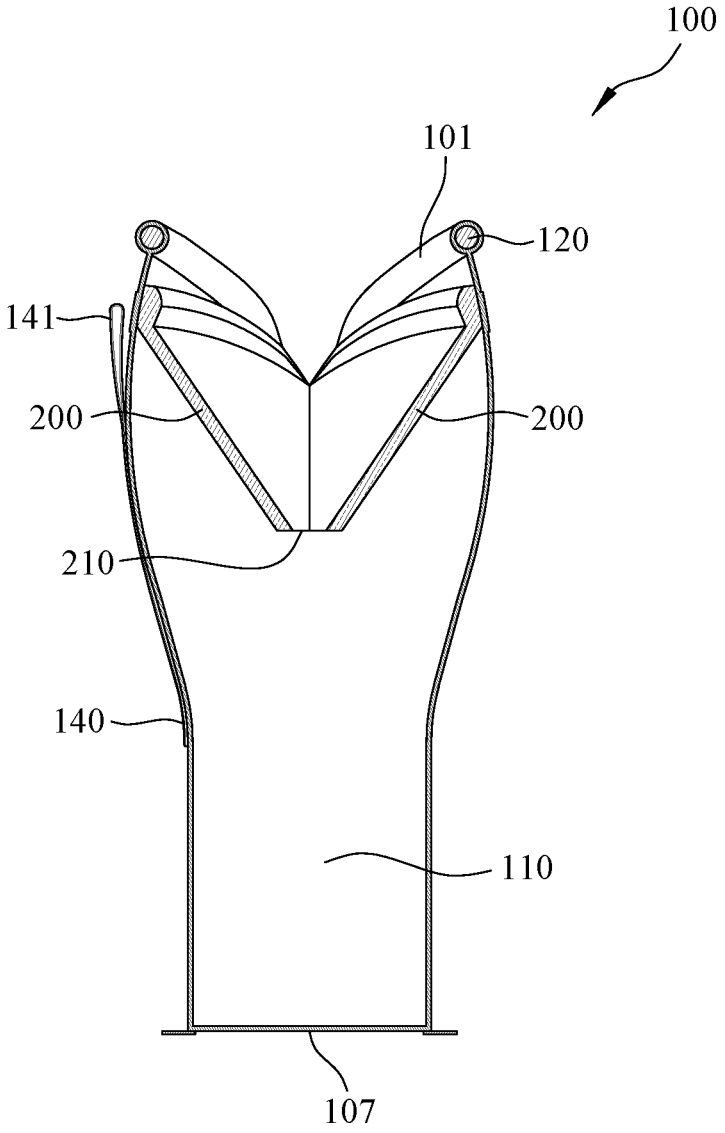
FIG. 5 illustrates a lateral cross-sectional view of the tool bag according to the first embodiment of the present invention.

Referring to FIGS. 4 and 5, wherein FIG. 4 illustrates a front cross-sectional view of the tool bag according to the first embodiment of the present invention; and FIG. 5 illustrates a lateral cross-sectional view of the tool bag according to the first embodiment of the present invention. As shown, the two flexible sheets 200 are attached or stitched to two opposite inner side surfaces of the main bag body 100 in such a manner that the two flexible sheets 200 cooperatively conceal the receiving space 110 at a lower level but exposing the upward opening 101 at an upper level. Note that after attachment of the flexible sheets 200, the third and fourth sides 105, 106 of the main bag body 100 cooperatively form the restricted portion 102 due to upper portions of the first and second sides 103, 104 are slightly drawn toward each other owing to attachment of the two flexible sheets 200 in the main bag body. Hence, the flexible sheets 200 define in a normal condition a flexible upper opening 210 proximate to the upward opening 101 of the main bag body 100 and a lower bottom that is distal from the upward opening 101, that is located within the receiving space 110 and that define a cross section smaller than the upper opening 210, thereby preventing tools in the receiving space 110 from falling out of the main bag body 100. Plastic sheets and/or nylon sheets and foamed sheets of relative thickness can be selected for serving as the flexible sheets 200. However the materials should not be limited only to these example ones.

Figure 6:
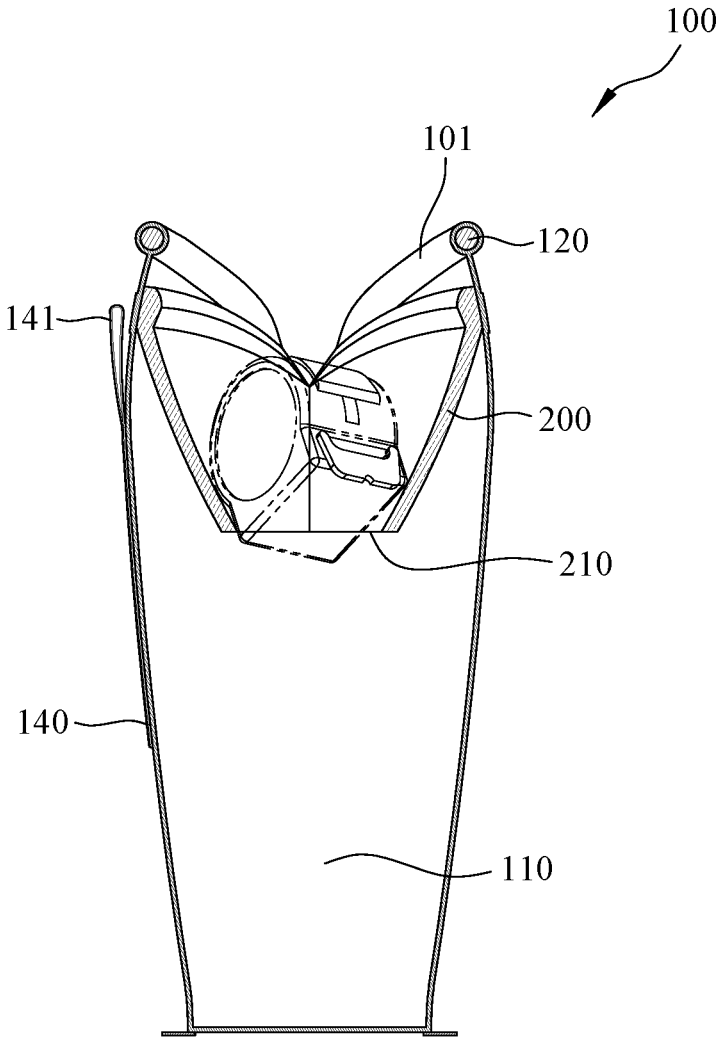
FIGS. 6 and 7 respectively illustrate a cross-sectional view of the tool bag according to the first embodiment of the present invention in use to prevent falling of tools therefrom.
Figure 7:
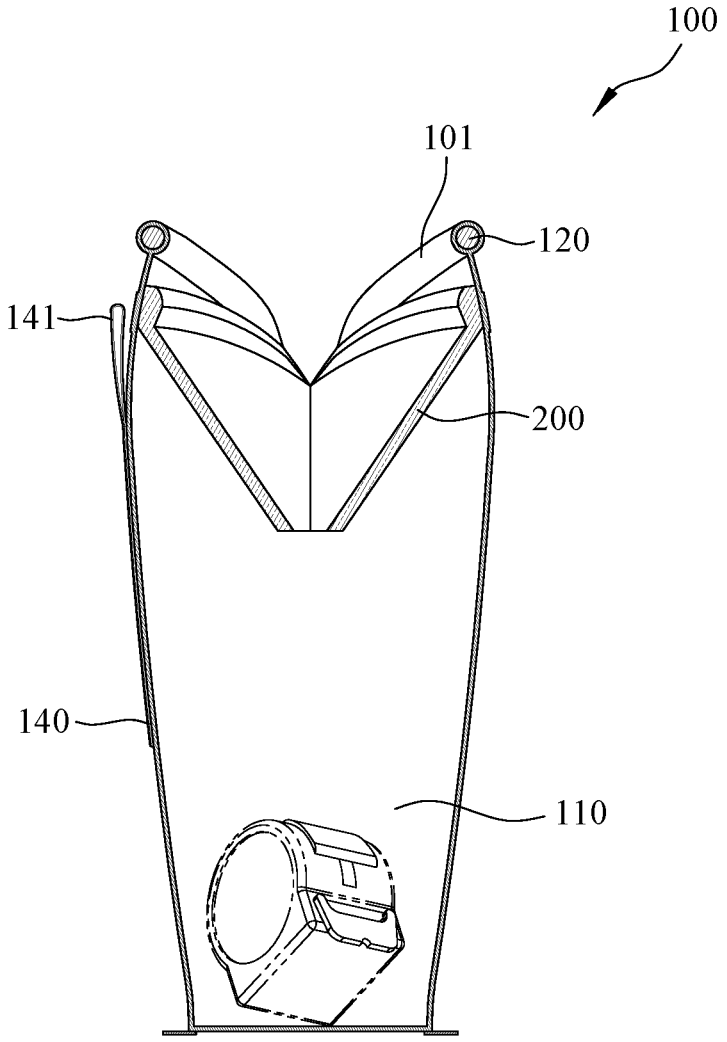

FIGS. 6 and 7 respectively illustrate a cross-sectional view of the tool bag according to the first embodiment of the present invention in use to prevent falling of tools from the same. As illustrated and explained above, since the flexible sheets 200 define the upper opening 210 that gradually reduces toward the lower bottom. In other words, the upper opening 210 of the flexible sheets 200 form a V-shape cross-section when viewed from a lateral side such that putting of tools (shown by dotted lines) into the receiving space 110 is facilitated. In the same manner, in case the bag body 100 is turned upside down or tilted accidentally, the lower bottom of the flexible sheets 200 prevents tools from falling out of the main bag body 100, as best shown in FIG. 7, due to restoration of the lower bottom of the flexible sheets 200 to its initial shape or configuration.

Figure 8:
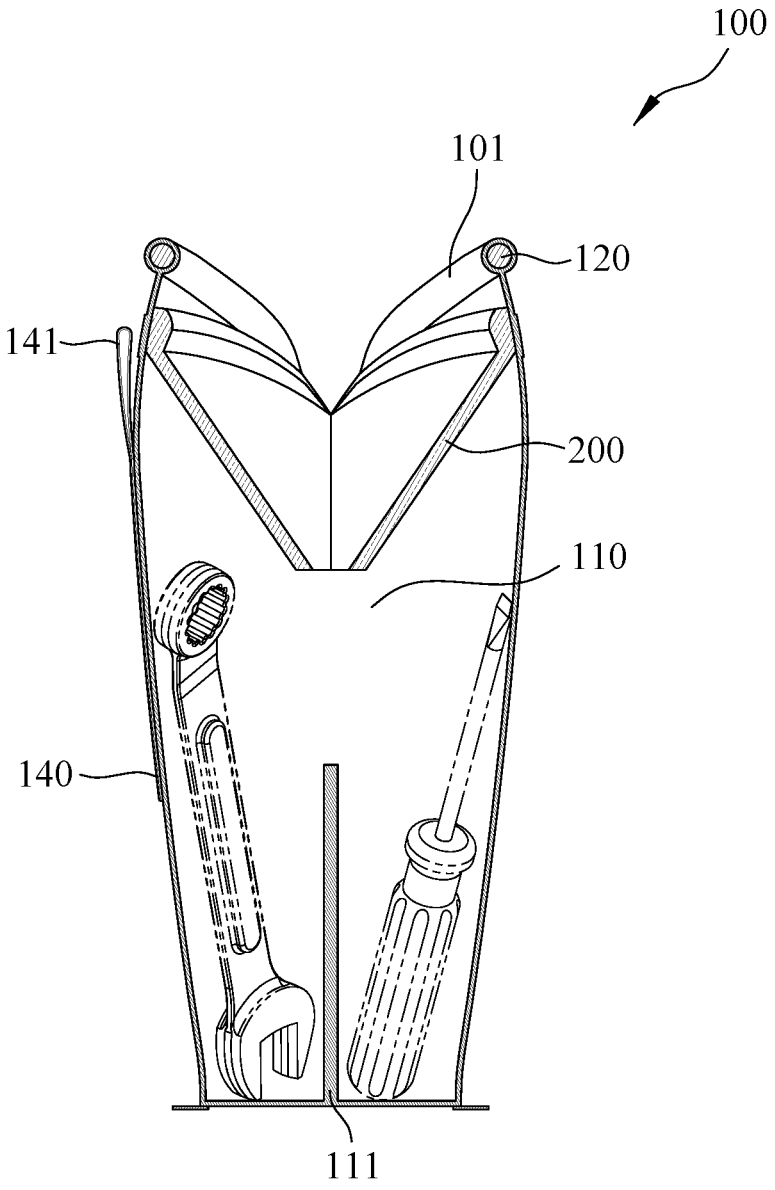
FIG. 8 illustrates a lateral cross-sectional view of a tool bag according to a second embodiment of the present invention.

FIG. 8 illustrates a lateral cross-sectional view of a tool bag according to a second embodiment of the present invention. The tool bag according to the second embodiment has the structure similar to the first embodiment, except that the tool bag of the second embodiment further includes a spacer element 111 mounted on the bottom side 107 of the main bag body 100 and extending upward to terminate adjacent to the lower bottom defined by the two flexible sheets 200, thereby separating the receiving space 110 into different layers or several chambers to facilitate placement of tools therein. Of course, when the receiving space is divided into different layers or several chambers, more ventilation holes can be arranged to enhance air circulation of the tool bag of the present invention.

Figure 9:
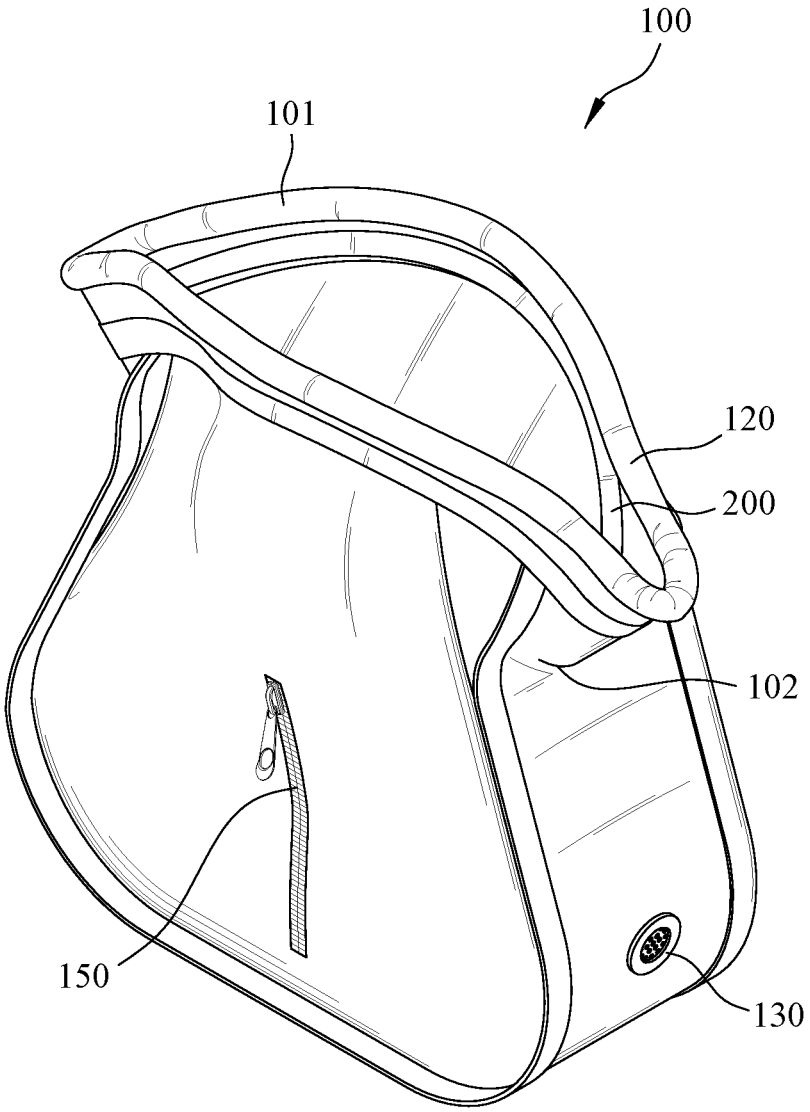
FIG. 9 shows a perspective view of a tool bag according to a third embodiment of the present invention.

FIG. 9 shows a perspective view of a tool bag according to a third embodiment of the present invention. The tool bag according to the third embodiment has the structure similar to the first embodiment, except that the tool bag of the third embodiment further includes a zipper 150 stitched to an outer side surface of the main bag body 100 such that pulling of the zipper 150 in two opposite directions result in permitting access into and/or denying access into the receiving space 110.

Figure 10:
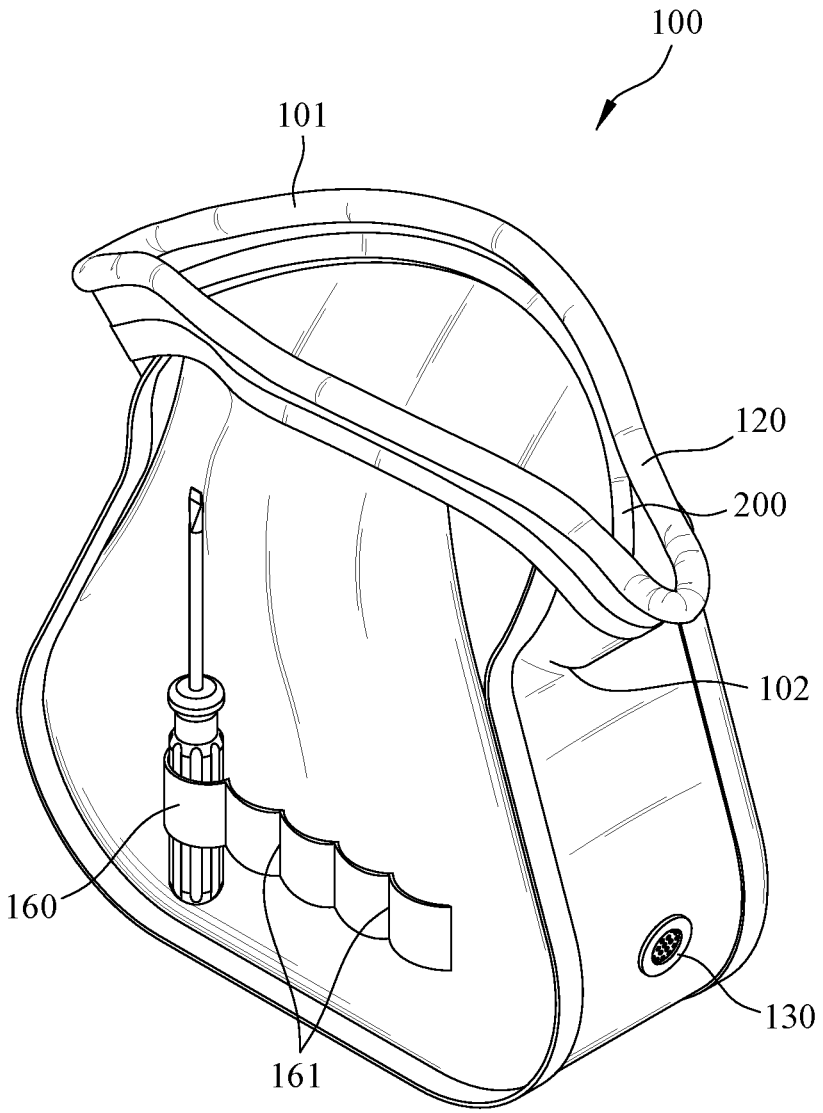
FIG. 10 shows a perspective view of a tool bag according to a fourth embodiment of the present invention.

FIG. 10 shows a perspective view of a tool bag according to a fourth embodiment of the present invention. The tool bag according to the fourth embodiment has the structure similar to the first embodiment, except that the tool bag of the fourth embodiment further includes a flexible strap 160 stitched on an outer side surface of the main bag body 100 in such a manner to define a plurality parallel stitched seams 161 adjacent two of which define an insert hole in which a tool can be kept therein.

Note that canvas sheets and/or sackcloth and/or gunny cloth of relative thickness can be selected for fabrication of the main bag body 100. Preferably, transparent materials can also be selected for fabrication of the main bag body 100 or the latter should be provided with a transparent window so as to facilitate fetching of a desired tool from the receiving space 110 of the main bag body 100.

Since the tool bag of the present invention is usually attached to a belt, which in turn, is buckled around a worker's waist, the upper opening 210 of the flexible sheets 200 form a V-shape cross-section when viewed from a lateral side such that putting of tools into the receiving space 110 is facilitated. In the same manner, the lower bottom of the flexible sheets 200 prevents tools from falling out of the main bag body 100, due to restoration of the lower bottom of the flexible sheets 200 to its initial shape or configuration, an inherent property provided by the flexible materials from which the flexible sheets 200 are fabricated.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A tool bag comprising:

a main bag body having an upward opening, first and second sides mutually symmetrically situated relative to each other, third and fourth sides mutually symmetrically situated relative to each, and a bottom side connected to lower ends of said first, second, third and fourth sides to define a receiving space accessible from said upward opening, wherein a periphery defining said upward opening is bent and stitched in such a manner to form an enclosed space for receiving a flexible edge plate therein such that said upward opening defines a gap that gradually decreases from a middle portion toward two opposite ends of said middle portion; and at least two flexible sheets attached to two opposite inner side surfaces of said main bag body in such a manner that said two flexible sheets cooperatively conceal said receiving space at a lower level but exposing said upward opening at an upper level, wherein said flexible sheets define in a normal condition an upper opening proximate to said upward opening of said main bag body and a lower bottom that is distal from said upward opening, that is located within said receiving space and that define a cross section smaller than said upper opening, thereby preventing tools in said receiving space from falling out of the main bag body.

2. The tool bag according to claim 1, wherein said third and fourth sides of said main bag body cooperative form a restricted portion having a cross section smaller than said upward opening of said main bag body.

3. The tool bag according to claim 1, further comprising a fastener strap mounted on an outer side surface of said main bag body in order to facilitate extension of a belt through for buckling said main bag body around a person's waist.

4. The tool bag according to claim 3, wherein said fastener strap is further provided with a hanging loop such that said main bag body is adapted to be hung to the belt buckled around the worker's waist.

5. The tool bag according to claim 1, further comprising a ventilation hole formed through said main bag body such that said receiving space is spatially communicated with an exterior of said main bag body.

6. The tool bag according to claim 1, further comprising a spacer element mounted on said bottom side of said main bag body and extending upward to terminate adjacent to said lower bottom defined by said two flexible sheets.

7. The tool bag according to claim 1, further comprising a zipper stitched to said main bag body such that pulling of said zipper in two opposite directions result in permitting access into and/or denying access into said receiving space.

8. The tool bag according to claim 1, further comprising a flexible strap stitched on an outer side surface of said main bag body in such a manner to define a plurality parallel stitched seams adjacent two of which define an insert hole in which a tool can be kept therein.

* * * * *